US005725811A

United States Patent [19]

Nguyen et al.

[11] Patent Number: 5,725,811

[45] Date of Patent: *Mar. 10, 1998

[54] IOL TUMBLING PROCESS

[75] Inventors: Tien Phuc Nguyen, Costa Mesa; Michael W. Orchowski, Laguna Beach; Moises A. Valle, Glendale, all of Calif.

[73] Assignee: Chiron Vision Corporation, Claremont, Calif.

[ * ] Notice: The term of this patent shall not extend beyond the expiration date of Pat. No. 5,571,558.

[21] Appl. No.: 743,639

[22] Filed: Nov. 4, 1996

Related U.S. Application Data

[63] Continuation of Ser. No. 78,285, filed as PCT/US92/08605 Nov. 11, 1992, Pat. No. 5,571,558.

[51] Int. Cl.[6] ..... B24B 31/00; B29C 37/02; B29D 11/00; B05D 3/12

[52] U.S. Cl. ..... 264/2.7; 264/340; 427/215; 427/242; 451/32; 451/35

[58] Field of Search ..... 264/2.6, 2.7, 161, 264/340; 427/215, 242; 451/32, 35

[56] References Cited

U.S. PATENT DOCUMENTS

| | | | |
|---|---|---|---|
| 2,084,427 | 6/1937 | Broderson | 264/161 |
| 2,380,653 | 7/1945 | Kopplin | 51/282 |
| 2,387,034 | 10/1945 | Milano | 264/161 |
| 2,947,124 | 8/1960 | Madigan et al. | 51/282 |
| 3,030,746 | 10/1962 | Firestine et al. | 51/284 |
| 3,656,921 | 4/1972 | Willcox | 427/215 |
| 3,816,107 | 6/1974 | Searight et al. | 428/406 |
| 3,876,450 | 4/1975 | Tanner | 427/242 |
| 4,110,085 | 8/1978 | Balz | 451/32 |
| 4,485,061 | 11/1984 | Akhavi et al. | 264/161 |
| 4,541,206 | 9/1985 | Akhavi | 51/217 |
| 4,551,949 | 11/1985 | Akhavi et al. | 51/164.1 |
| 4,580,371 | 4/1986 | Akhavi | 51/313 |
| 4,668,446 | 5/1987 | Kaplan et al. | 264/2.6 |
| 4,788,080 | 11/1988 | Hojo et al. | 427/215 |
| 4,856,234 | 8/1989 | Goins | 51/284 |
| 4,911,190 | 3/1990 | Sheldon | 134/85 |
| 5,074,908 | 12/1991 | Boswell et al. | 427/242 |
| 5,104,590 | 4/1992 | Blake | 264/2.5 |
| 5,133,159 | 7/1992 | Nelson | 451/32 |
| 5,185,107 | 2/1993 | Blake | 264/2.5 |

FOREIGN PATENT DOCUMENTS

| | | | |
|---|---|---|---|
| 1144076 | 2/1963 | Germany . | |
| 1596833 | 10/1970 | Germany | 427/215 |
| 3-54126 | 3/1991 | Japan | 427/215 |
| 93/06967 | 4/1993 | WIPO . | |

*Primary Examiner*—Robert Davis
*Attorney, Agent, or Firm*—Loeb & Loeb LLP

[57] ABSTRACT

A process of removing flash from a molded intraocular lens includes a step of tumbling the lens body in a tumbling media. The tumbling media includes a mixture of 0.5 mm diameter glass beads and 1.0 mm diameter glass beads, alcohol and water. This process applies to single piece and multipiece IOLs.

16 Claims, 1 Drawing Sheet

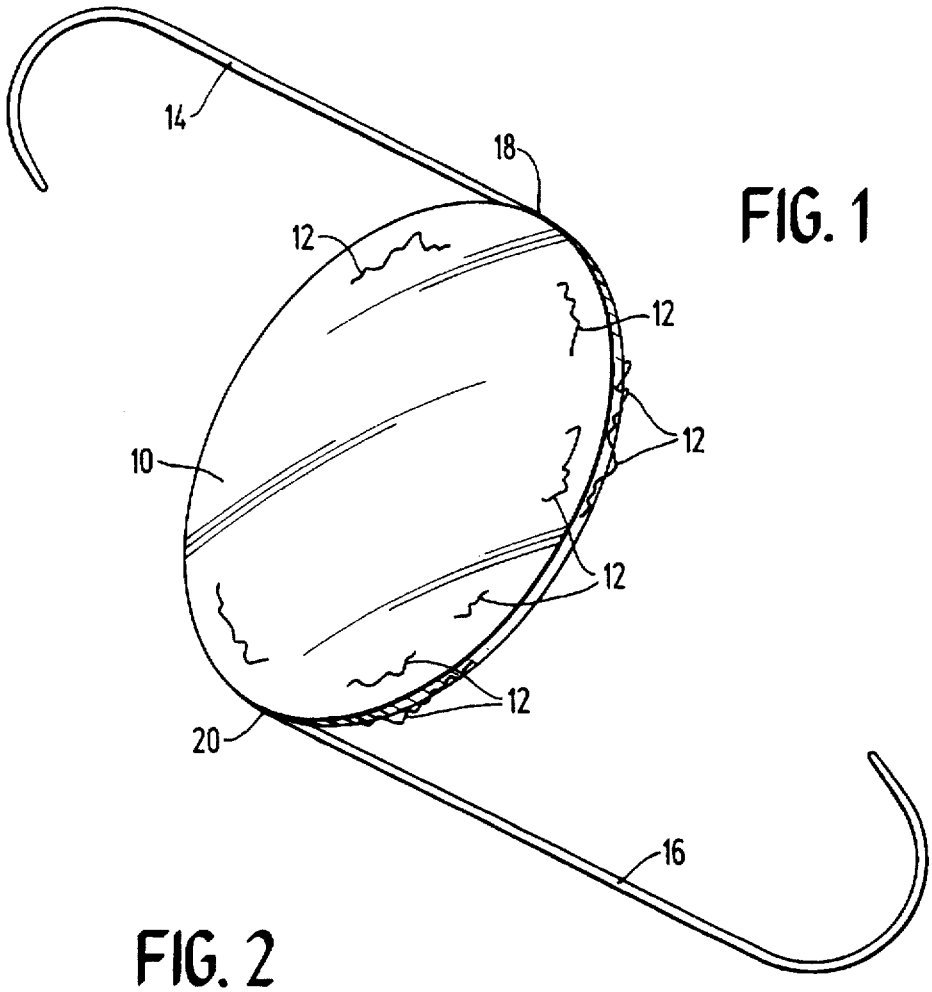
FIG. 1
FIG. 2
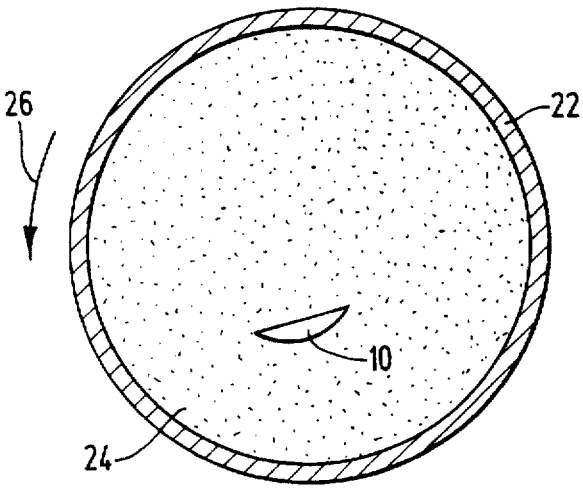
FIG. 3
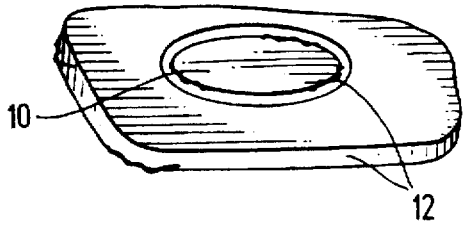

IOL TUMBLING PROCESS

This is a continuation of application Ser. No. 08/078,285 filed on Jun. 27, 1994 and now U.S. Pat. No. 5,571,558, which is the national stage of PCT No. PCT/US92/08605 filed on Nov. 11, 1992.

BACKGROUND OF THE INVENTION

1. Field of the Invention

The present invention relates to manufacturing processes for intraocular lenses (IOLs), tumbling processes used in the manufacture of molded IOLs and IOLs manufactured with the processes.

2. Related Art

Methods of molding articles from a moldable material, such as plastic, have been practiced for quite some time. A common problem associated with molding processes is the formation of excess material or flash on the molded article. Depending upon the type article formed in the molding process and the manner in which the article is used, the existence of excess material or flash can be undesirable.

Prior methods of removing flash from molded articles include such labor intensive processes as cutting the flash with a blade or scissors. However, such cutting methods can be extremely time consuming and expensive, especially when a large number of articles are being manufactured.

Methods of removing flash by tumbling the molded article in a rotatable tumbling container have been successfully practiced. For example, U.S. Pat. No. 2,084,427 to Boderson and U.S. Pat. No. 2,387,034, to Milano describe methods of making plastic articles, buttons in particular, which include steps of tumbling the articles to remove projections of excess material or flash. Similarly, U.S. Pat. No. 4,485,061 to Akhavi et al. describes a method of processing plastic filaments which includes "abrasive tumbling" to remove excess material.

A cold temperature tumbling process is described in U.S. Pat. No. 2,380,653 to Kopplin. According to this method, flash is removed from a molded article by tumbling the article in a rotatable container of dry ice and small objects, such as wooden pegs. The cold temperature resulting from the dry ice renders the flash material relatively brittle, such that the flash is more easily broken off of the article during the tumbling process.

U.S. Pat. No. 3,030,746 to Firestine, et al. describes a grinding and polishing method for optical glass, including glass lenses. The method includes a tumbling process wherein the glass articles are placed in a composition of a liquid, and abrasive and small pellets or media. The liquid is described as being water, glycerins, kerosine, light mineral oil and other organic liquids either alone or in combination; the abrasive is described as being garnet, corundum, boron carbide, cortz, aluminum oxide, emery or silicon carbide; and the media is described as being ceramic cones, plastic slugs, plastic molding, powder, limestone, synthetic aluminum oxide chips, maple shoe pegs, soft steel diagonals, felt, leather, corn cobs, cork or waxes.

Another example of a tumbling process used in the manufacture of optical lenses (including certain types of intraocular lenses) is described in U.S. Pat. No. 4,541,206 to Akhavi and U.S. Pat. No. 4,580,371, also to Akhavi. These patents describe a lens holder or fixture used for holding a lens in a process of rounding the edge of an optical lens. The process includes an "abrasive tumbling" step carried out with an "abrasive medium" 70 in a tumbler 72.

Prior methods of removing flash, such as described above, may be inadequate or impractical in the manufacture of certain types of intraocular lenses (IOLs). For example, certain modern IOLs are formed with a relatively soft, highly flexible material, such as a silicone material (e.g., Silicon "RMX-3 or RMX-3W), which is susceptible to chemical and/or physical changes when subjected to cold temperatures. Therefore, certain types of cryo-tumbling (or cold temperature tumbling) may be impractical in the manufacture of lenses made from such soft lens material. In addition, certain types of abrasive tumbling processes may be suitable for harder lens material, such as glass or polymethylmethacrylate (PMMA), but may not be suitable for softer lens material, such as Silicon RMX-3 or RMX-3W. Therefore, a need exists for a suitable process for removing flash from molded lens bodies made of a relatively soft lens material, such as Silicon RMX-3 or RMX-3 W.

SUMMARY OF THE DISCLOSURE

The present invention relates to manufacturing processes for intraocular lenses (IOLs), tumbling processes used in the manufacture of molded IOLs and IOLs manufactured with such processes. According to an embodiment of the invention, a process for removing flash from a molded silicon IOL involves a step of tumbling the IOL in a tumbling medium designed to be suitable for soft or foldable lens body materials.

According to a preferred embodiment, the lens is tumbled in a mixture of glass beads of first and second diameters, e.g., 0.5 mm and 1.0 mm diameter glass beads. The tumbling mixture also includes alcohol and deionized water. A quantity of lenses which has been initially cleaned of heavy flash in the corner of the haptic area and on the lens periphery for multipiece and single piece (edge only) lenses are placed in the tumbling mixture and are tumbled at approximately 80 rpms for approximately 72 hours. Then, additional alcohol is added. The tumbling process continues to run at approximately the same rpms for an additional 3 hours. Then, the tumbling machine is stopped. The lenses are separated from the tumbling medium, are soaked in alcohol and are ultrasonically cleaned. By this process, lenses made with soft lens body material may be manufactured using a tumbling process for removing additional flash around haptic connection area and the lens peripheral surface. As a result, a reduction of the time required to remove flash from a soft lens body is achievable.

BRIEF DESCRIPTION OF THE DRAWINGS

The detailed description of embodiments of the invention will be made with reference to the accompanying drawings, wherein like numerals designate corresponding parts in the several figures.

FIG. 1 is a prospective view of a multipiece molded lens body with excess material or flash.

FIG. 2 is a schematic view of a lens and tumbling media in a tumbling container.

FIG. 3 is a prospective view of a single piece molded lens body with excess material or flash.

DETAILED DESCRIPTION OF THE PREFERRED EMBODIMENTS

The following detailed description is of the best presently contemplated mode of carrying out the invention. This description is not to be taken in a limiting sense, but is made merely for the purpose of illustrating general principles of embodiments of the invention. The scope of the invention is best defined by the appended claims.

The present invention relates to manufacturing processes for intraocular lenses (IOLS), tumbling processes used in the manufacture of molded IOLS and IOLS manufactured with such processes. According to embodiments of the invention, an IOL is manufactured according to a process which includes a molding step for forming a rough lens body, a flash-removing step for removing flash and rough surfaces from the molded lens body and a lens body cleaning step. According to embodiments of the invention, these steps are designed to be particularly well-suit for manufacturing IOLS having relatively soft, flexible lens bodies, such as made from silicon, RMX-3. These steps allow an improved practical use of tumbling processes in the manufacture of soft, flexible lens bodies.

A lens body is molded by providing a lens body material (such as that described in the co-filed and commonly assigned United States Patent Application titled Method For Filtering Highly Viscous Liquids Used In The Manufacturing of Ophthalmic Lenses, filed by U.S. Express Mail No. GB205010135 material, incorporated herein by reference) in a mold, curing or hardening the lens body material within the mold, and removing the cured or hardened rough lens body (10 in FIG. 1) from the mold. The molding process can be accomplished according to conventional impact molding processes or compression, injection or transfer molding.

As a result of the molding process, excess material or flash 12 is formed around the periphery of the rough lens body 10, as shown in FIG. 1 and FIG. 3. Haptic elements 14 and 16 may be molded with or otherwise attached to the lens body at connection locations 18 and 20, respectively. In the past, removal of flash from a lens body, especially around the Haptic connection areas 18 and 20, has been relatively time-consuming and expensive.

According to embodiments of the present invention, a tumbling process designed to be compatible with soft silicone lens bodies is employed to remove excess flash. Prior to the tumbling process, heavy flash build-ups, such as around the haptic connection areas 18 and 20, or at the periphery of multipiece and single piece lenses are removed, e.g., with a blade and/or tweezers. The lens body is then placed in a tumbling container 22 (FIG. 2) having a tumbling media 24 therein. The tumbling media 24, according to embodiments of the invention, is designed to be compatible with soft silicone lens material. In particular, the tumbling media comprises a plurality of glass beads of first and second diameters, alcohol and deionized water. It has been found that the use of two different-sized glass beads with the alcohol and water solution will provide a suitable media for tumbling lenses made of soft lens material.

In a first preferred embodiment, the glass beads comprise a plurality of glass beads having a one-millimeter diameter and a second plurality of glass beads, having a 0.5 millimeter diameter. An example of the relative volumes of media components, according to a preferred embodiment for sample rotational tumbling is as follows:

300 ml of 0.5 mm glass beads;

300 ml of 1.0 mm glass beads;

200 ml of pure Ethynol alcohol; and 20 ml of deionized water.

For figure eight rotational tumbling a high percentage of glass beads is required.

Approximately 40–50 lens bodies may be placed in a tumbling container 22 having the above composition (and component volumes) of tumbling media therein. The tumbling machine is run at 80 rpms. ±20 rpms. for approximately 72 hours ±5 hours (e.g., the tumbling container 22 is rotated in the direction of arrow 26 at approximately 80 rpms. for the above-noted time period). Then, the tumbling machine is stopped and approximately 50 milliliters of pure alcohol is added to the tumbling container 22. Then the tumbling machine is started again to run at approximately the same rpms. for approximately 3 hours. After the three-hour run, the tumbling machine is stopped and the lenses are separated from the tumbling media. For the figure eight rotational tumbling the different speed and duration will apply.

The lenses are then subjected to a cleaning step, wherein the lenses are placed in a container of alcohol (an alcohol bath). In a preferred embodiment, the lenses and alcohol bath may be placed in an ultrasonic tank and cleaned, ultrasonically, for approximately twenty minutes.

As a result of the above process, a lens body may be manufactured having relatively smooth surfaces and having minimal or no flash remnants. Moreover, the above process is particularly well-suited for soft lens material which, heretofore, could not ordinarily be subjected to tumbling operations without severe damage to the soft lens material.

The above manufacturing steps and tumbling steps are particularly well-suited for soft IOL lens bodies, but may be used in the manufacture of other types of lens bodies as well. A soft-bodied IOL, e.g., made of silicon RMX-3, can be manufactured according to the above-noted process, relatively economically, since the flash removal step is made much less labor-intensive by the unique tumbling process. When a tumbling process is employed in the manufacture of lens bodies having haptic elements connected thereto, it is desirable to reinforce the haptic connections. Examples of haptic reinforcements are described in the co-filed and commonly assigned United States Patent Application titled Improved Haptic Element Connections And Intraocular Lenses filed by U.S. Express Mail No. GB205010135 (incorporated herein by reference).

Various aspects of the above manufacturing steps and tumbling steps are particularly well-suited for single piece UV silicone soft IOL lens. In a further preferred embodiment for tumbling such single piece IOL lenses, a tumbling solution, comprising about 91% absolute alcohol and 9% purified water, is mixed with approximately 1300 grams of treated (as discussed below) glass beads of 0.5 mm diameter in a 100 mL polyethylene jar. About 100 soft IOL lens bodies are placed in the jar for tumbling. The tumbling process is carried out in a FIG. 8 tumbler for approximately 48 hours.

As noted above, the glass beads are treated prior to being added to the tumbling container. The pre-treatment of the beads is carried out in order to smooth the otherwise relatively rough surfaces of the beads, yet provide the beads with sufficient abrasiveness to remove excess flash from the IOL lens bodies during the tumbling process. This provides significant benefits in the manufacture of soft IOL lenses, in that the relatively soft silicone material used in the lens body of such lenses can be easily scratched or marred by overly abrasive beads, while non-abrasive beads may not provide sufficient flash removal. It is noted that pre-treated beads as discussed herein provide the above mentioned benefits and also remove material from the optical surface, therefore, rendering the IOL's radius of curvature slightly smaller, causing an upward shift in diopter.

According to one embodiment, bead pre-treatment steps comprise a five day cycle. In particular, the beads are tumbled in a mixture of diatomaceous earth and isopropyl alcohol (IPA) for approximately 3 days. Then the beads are subjected to two approximately 24-hour cycles of rinsing in IPA. Next, the beads are tumbled in a mixture of aluminum oxide and IPA for approximately 6 hours. This pre-treatment process applies a layer of aluminum oxide on the glass beads and renders the beads abrasive to the desired degree for tumble processing soft IOL lens bodies.

The beads, after being pre-treated, are then suitable for approximately three separate IOL tumbling processes, e.g., in a FIG. 8 tumbler for approximately 48 hours per tumbling process, as discussed above. Following the three separate IOL tumbling processes, the beads may be re-treated in the same manner as discussed above with respect to the pre-treatment steps. The use of a figure-8 tumbler provides significant benefits in that the rotation about multiple rotation axes (as in a figure-8 tumbler) increases the occurances and angles of angagement of the beads with the lens bodies.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being illustrated by the appended claims, rather than the foregoing description, and all changes which come within the meaning and range of equivalency of the claims are therefore intended to be embraced therein.

What is claimed is:

1. A method of processing at least one lens made of lens material selected from a group of soft lens material and foldable lens material, the method comprising the steps of:

applying a coating of abrasive material on a plurality of beads;

containing the coated beads in a tumbling container;

adding at least one lens to the tumbling container; and tumbling the lens with the coated beads to remove at least some lens material from the lens.

2. A method as claimed in claim 1, wherein the beads comprise glass beads.

3. A method as claimed in claim 1, wherein the step of tumbling comprises rotating the tumbling container at 80 rpms ±20 rpms for approximately 72 hours ±5 hours, adding more alcohol and rotating the tumbling container at approximately 80 rpms ±20 rpms for approximately 3 hours.

4. A method as claimed in claim 1, further comprising the step of placing the lens in an alcohol bath following the tumbling step.

5. A method as claimed in claim 4, further comprising the step of subjecting the lens to an ultrasonic cleaning process for approximately 20 minutes following the alcohol bath.

6. A method as claimed in claim 1, wherein the tumbling container comprises a figure-8 tumbler container.

7. A method as claimed in claim 1, wherein the step of applying a layer of abrasive material on the beads comprises the steps of:

tumbling the beads in a mixture of diatomaceous earth and isopropyl alcohol;

rinsing the beads with isopropyl alcohol following the bead tumbling step; and tumbling the rinsed beads in a mixture of abrasive material and isopropyl alcohol.

8. A method as claimed in claim 7, wherein the step of tumbling the beads in diatomaceous earth and isopropyl alcohol is carried out for approximately three days, the step of rinsing the beads is carried out for approximately two 24-hour cycles and the step of tumbling the rinsed beads is carried out for approximately 6 hours.

9. A method as claimed in claim 1, wherein the step of applying a coating of abrasive material on the beads comprises the step of tumbling the beads in a mixture of abrasive material and alcohol.

10. A method as claimed in claim 1, wherein the step of applying a coating of abrasive material comprises applying a coating of aluminum oxide to the beads.

11. A method as claimed in claim 1, wherein the lens material is a silicone material.

12. A method of processing at least one lens made of lens material selected from a group of soft lens material and foldable lens material, the method comprising the steps of:

containing beads coated with an abrasive material in a tumbling container;

adding at least one lens to the tumbling container; and tumbling the lens with the coated beads to remove at least some lens material from the lens.

13. A method as claimed in claim 12, wherein the lens material is a silicone material.

14. A method as claimed in claim 12, further comprising the step of adding an aqueous solution comprising an alcohol and water to the tumbling container.

15. A method as claimed in claim 12, wherein the beads coated with an abrasive material comprises beads coated with aluminum oxide.

16. A method as claimed in claim 12, wherein the beads coated with an abrasive material comprises glass beads coated with an abrasive material.

* * * * *